US011217904B2

(12) United States Patent
Li et al.

(10) Patent No.: US 11,217,904 B2
(45) Date of Patent: Jan. 4, 2022

(54) WIDE ANGLE COVERAGE ANTENNA WITH PARASITIC ELEMENTS

(71) Applicant: APTIV TECHNOLOGIES LIMITED, St. Michael (BB)

(72) Inventors: Mingjian Li, Agoura Hills, CA (US); Shawn Shi, Thousand Oaks, CA (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 376 days.

(21) Appl. No.: 16/219,248

(22) Filed: Dec. 13, 2018

(65) Prior Publication Data

US 2019/0245276 A1 Aug. 8, 2019

Related U.S. Application Data

(60) Provisional application No. 62/626,961, filed on Feb. 6, 2018.

(51) Int. Cl.

| | |
|---|---|
| ***H01Q 21/06*** | (2006.01) |
| ***H01Q 15/00*** | (2006.01) |
| ***H01Q 13/20*** | (2006.01) |
| ***H01Q 1/32*** | (2006.01) |
| ***H01Q 5/385*** | (2015.01) |
| ***H01Q 1/38*** | (2006.01) |

(52) U.S. Cl.

CPC ..... *H01Q 21/065* (2013.01); *H01Q 1/3233* (2013.01); *H01Q 1/38* (2013.01); *H01Q 5/385* (2015.01); *H01Q 13/206* (2013.01); *H01Q 15/008* (2013.01)

(58) Field of Classification Search

CPC .... H01Q 13/206; H01Q 21/065; H01Q 5/385; H01Q 1/3233; H01Q 1/38; H01Q 15/008

See application file for complete search history.

(56) References Cited

U.S. PATENT DOCUMENTS

| | | | | |
|---|---|---|---|---|
| 6,262,495 | B1 | 7/2001 | Yablonovitch et al. | |
| 2007/0004363 | A1* | 1/2007 | Kusaka ..... | H01Q 1/007 455/269 |
| 2008/0198085 | A1* | 8/2008 | Hsu ..... | H01Q 21/08 343/795 |

(Continued)

FOREIGN PATENT DOCUMENTS

| | | |
|---|---|---|
| CN | 1274966 A | 11/2000 |
| CN | 1964135 A | 5/2007 |

(Continued)

OTHER PUBLICATIONS

European Search Report for Application No. 19152734.0, European Patent Office, dated Jun. 24, 2019.

(Continued)

*Primary Examiner* — Andrea Lindgren Baltzell
*Assistant Examiner* — Noel Maldonado
(74) *Attorney, Agent, or Firm* — Carlson, Gaskey & Olds

(57) ABSTRACT

An illustrative example antenna device includes a substrate, a transmission line supported on the substrate, and a plurality of conductive patches supported on the substrate. Each conductive patch has a first end coupled to the transmission line and a second end coupled to ground. The plurality of conductive patches are arranged in sets including two of the conductive patches facing each other on opposite sides of the transmission line.

18 Claims, 4 Drawing Sheets

(56) References Cited

U.S. PATENT DOCUMENTS

| | | | | |
|---|---|---|---|---|
| 2010/0134376 | A1* | 6/2010 | Margomenos | H01P 5/028 343/848 |
| 2013/0222204 | A1* | 8/2013 | Binzer | H01Q 13/206 343/853 |
| 2014/0078005 | A1* | 3/2014 | Park | H01Q 13/206 343/700 MS |
| 2016/0141748 | A1* | 5/2016 | Tagi | H01Q 1/525 342/175 |

FOREIGN PATENT DOCUMENTS

| | | | |
|---|---|---|---|
| CN | 106169645 | A | 11/2016 |
| CN | 107492705 | A | 12/2017 |
| DE | 2824053 | A1 | 12/1978 |
| EP | 3096402 | A1 | 11/2016 |
| GB | 1294024 | | 10/1972 |
| GB | 1572273 | | 7/1980 |
| JP | 6017003 | | 10/2016 |

OTHER PUBLICATIONS

Yuanxin Li et al.: "The Periodic Half-Width Microstrip Leaky-Wave Antenna With a Backward to Forward Scanning Capability", IEEE Transactions on Antennas and Propagation, IEEE Service Center, Piscataway, NJ, US, vol. 57, No. 3, Mar. 3, 2010, pp. 963-966.
Office Action for Chinese Application No. 201910110306.5 dated Jul. 13, 2021.

* cited by examiner

WIDE ANGLE COVERAGE ANTENNA WITH PARASITIC ELEMENTS

CROSS REFERENCE TO RELATED APPLICATIONS

This application claims priority to U.S. Provisional Application No. 62/626,961, which was filed on Feb. 6, 2018, the entirety of which is incorporated by reference.

BACKGROUND

Increasing amounts of technology are included on automotive vehicles. Radar and lidar sensing devices provide the capability to detect objects in a vicinity or pathway of the vehicle. Many such devices include a radiating antenna that emits the radiation used for object detection.

While different antenna types have proven useful, they are not without shortcomings or drawbacks. For example, some antennas that are useful for short or medium range detection have the capability of covering a wide field of view, but experience high loss when the electromagnetic wave radiated from the antenna passes through the fascia of the vehicle. Such high losses are typically associated with vertical polarization of the antenna. One attempt to address that problem is to incorporate horizontal polarization. The difficulty associated with horizontal polarization, however, is that the impedance bandwidth is typically too narrow to satisfy production requirements. One approach to increase the impedance bandwidth includes increasing the thickness of the antenna substrate material. A disadvantage associated with that approach is that it increases cost.

Another difficulty associated with some known radar antenna configurations is the occurrence of high frequency ripples resulting from radiation scattering from nearby antennas, electronic components on the vehicle, and other metal or dielectric materials in close proximity to the antennas. A further complication is that the ripples in the radiation pattern for each antenna occur at different angles and that affects the uniformity of the radiation patterns of all the antennas used for radar. A non-uniform radiation pattern significantly lowers the angle finding accuracy of the radar system.

SUMMARY

An illustrative example antenna device includes a substrate, a transmission line supported on the substrate, and a plurality of conductive patches supported on the substrate. Each conductive patch has a first end coupled to the transmission line and a second end coupled to ground. The plurality of conductive patches are arranged in sets including two of the conductive patches facing each other on opposite sides of the transmission line.

In an example embodiment having one or more features of the antenna device of the previous paragraph, the conductive patches respectively have a distance between the first end and the second end, and an operating frequency of the antenna device is based on the distance.

In an example embodiment having one or more features of the antenna device of any of the previous paragraphs, the conductive patches respectively have a first width near the first end and a radiating power of the conductive patches, respectively, is based on the width.

In an example embodiment having one or more features of the antenna device of any of the previous paragraphs, the conductive patches respectively have a second width near the second end and the second width is different than the first width.

In an example embodiment having one or more features of the antenna device of any of the previous paragraphs, the first width of two of the conductive patches is different than the first width of two others of the conductive patches.

In an example embodiment having one or more features of the antenna device of any of the previous paragraphs, the two of the conductive patches are closer to a first end of the transmission line; the two others of the conductive patches are closer to a second, opposite end of the transmission line; and the first end of the transmission line is coupled to a source of radiation.

In an example embodiment having one or more features of the antenna device of any of the previous paragraphs, a radiating power of the conductive patches, respectively, is based on the second width.

In an example embodiment having one or more features of the antenna device of any of the previous paragraphs, the conductive patches are situated on one side of the substrate, the substrate includes a grounding layer spaced from the one side of the substrate, and the conductive patches respectively include a plurality of conductive vias coupled to the grounding layer.

In an example embodiment having one or more features of the antenna device of any of the previous paragraphs, a length between the second ends of the conductive patches in each set corresponds to a one-half wavelength in the substrate of radiation radiated by the conductive patches.

An example embodiment having one or more features of the antenna device of any of the previous paragraphs includes a conductive layer near the conductive patches and a plurality of conductive vias coupled between the conductive layer and ground.

In an example embodiment having one or more features of the antenna device of any of the previous paragraphs, the conductive layer comprises a plurality of parasitic conductive elements and each of the parasitic conductive elements is coupled with one of the conductive vias.

In an example embodiment having one or more features of the antenna device of any of the previous paragraphs, each conductive via is situated in a position relative to edges of a coupled one of the parasitic conductive elements and the position of some of the vias is different than the position of others of the vias.

In an example embodiment having one or more features of the antenna device of any of the previous paragraphs, the parasitic conductive elements coupled to the some of the vias are closer to the conductive patches than the parasitic conductive elements coupled to the others of the vias, and the respective position of the others of the vias is closer to a center of the respective coupled parasitic conductive elements than the position of the some of the vias.

In an example embodiment having one or more features of the antenna device of any of the previous paragraphs, the conductive layer is coupled to the second ends of the conductive patches and the conductive layer has a dimension parallel to the transmission line that is at least as long as the transmission line.

In an example embodiment having one or more features of the antenna device of any of the previous paragraphs, the conductive patches are on one surface of the substrate and the conductive layer is on the one surface of the substrate.

In an example embodiment having one or more features of the antenna device of any of the previous paragraphs, the transmission line comprises a differential twin line.

An example embodiment having one or more features of the antenna device of any of the previous paragraphs includes a source of radiation that provides an unbalanced signal and a transition coupling the source of radiation to the transmission line. The transition balances the unbalanced signal before the signal propagates along the transmission line.

In an example embodiment having one or more features of the antenna device of any of the previous paragraphs, the source of radiation comprises a substrate integrated waveguide and the transition comprises a balun.

In an example embodiment having one or more features of the antenna device of any of the previous paragraphs, the conductive patches each have a geometric configuration and the geometric configuration of the two conductive patches in each set is the same.

Various features and advantages of at least one disclosed example embodiment will become apparent to those skilled in the art from the following detailed description. The drawings that accompany the detailed description can be briefly describe as follows.

DETAILED DESCRIPTION

Embodiments of this invention provide an antenna including a transmission line and a plurality of conductive patches coupled with the transmission line. With embodiments of this invention, it is possible to achieve wider operation bandwidth and wider radiation beamwidth in a cost-effective manner while avoiding undesirable ripple effects.

Figure 1:
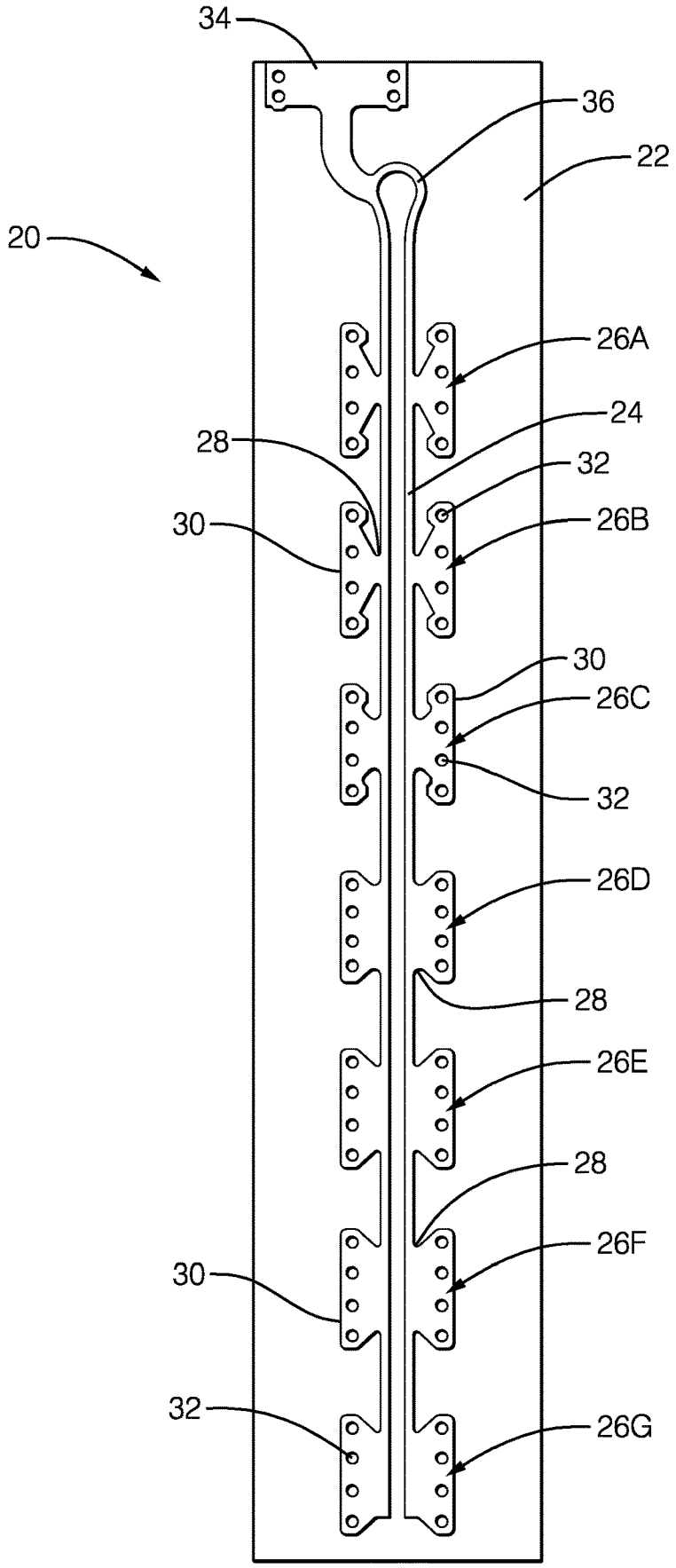
FIG. 1 schematically illustrates an example antenna designed according to an embodiment of this invention.

FIG. 1 illustrates an antenna device 20 that includes a substrate 22 and a transmission line 24 supported on the substrate 22. A plurality of conductive patches 26 are supported on the substrate 22. Each conductive patch 26 has a first end 28 coupled to the transmission line 24 and a second end 30 that is coupled to ground through conductive vias 32.

In the illustrated example, the transmission line 24 comprises a differential twin line and the conductive patches 26 are arranged in sets including two of the conductive patches 26 facing each other on opposite sides of the transmission line 24. Each of the sets 26A-26G includes two of the conductive patches 26 facing each other along the length of the transmission line 24. The conductive patches 26 are resonators for emitting radiation. The illustrated example includes a radiation source 34, such as a substrate integrated waveguide or a microstrip line. This embodiment includes a transition 36, such as a balun, that couples the source of radiation 34 to the transmission line 24. The transition 36 balances an unbalanced signal from the source of radiation 34 before that signal propagates along the transmission line 24.

Figure 2:
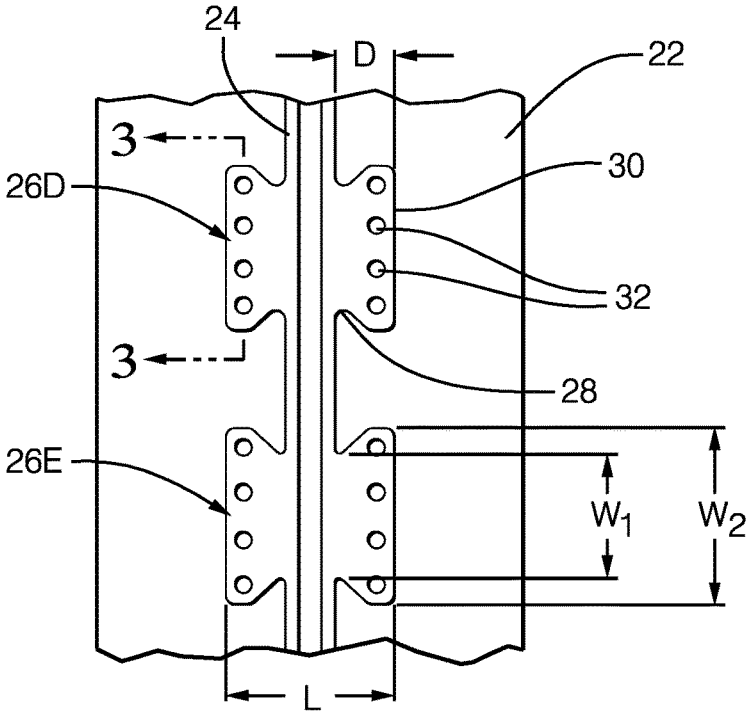
FIG. 2 illustrates selected features of the embodiment of FIG. 1.

As shown in FIG. 2, each of the conductive patches has a first width $W_1$ at the first end 28 and a second width $W_2$ at the second end 30. The first width $W_1$ is smaller than the second width $W_2$ for each of the example conductive patches 26. In other embodiments the widths $W_1$ and $W_2$ are equal. In the embodiment of FIG. 1, the first width $W_1$ of at least one of the sets of patches 26 is different than the first width $W_1$ of at least one other of the sets of conductive patches 26. As illustrated in FIG. 1, this example embodiment includes a different first width $W_1$ for each of the sets of conductive patches 26. In this example, the first width $W_1$ becomes progressively larger as the sets 26A-26G are spaced further from the source of radiation 34.

The differing first widths $W_1$ provide different resonating powers for the different sets of conductive patches. The sets of conductive patches 26C, 26D, 26E, 26F, and 26G have progressively larger first widths $W_1$ to provide for a tapered radiated power along the antenna device 20.

Each of the conductive patches 26 includes a distance D between the first end 28 and the second end 30. The distance D determines or controls an operating frequency of the antenna device. Those skilled in the art who have the benefit of this description will be able to select an appropriate distance D to achieve an operating frequency that meets their particular needs.

A length L between the second ends 30 of each set of conductive patches 26 corresponds to approximately a one-half wavelength in the substrate of the radiation radiated by the conductive patches 26.

The particular shape and arrangement of the conductive patches 26, in the illustrated example, achieves desired antenna performance for a radar detection system that is useful on an automotive vehicle for example. Other conductive patch shapes and arrangements are possible and those skilled in the art who have the benefit of this description will understand how to configure a plurality of conductive patches having features like those of the example conductive patches to achieve the desired antenna performance that will meet their particular needs.

Figure 3:
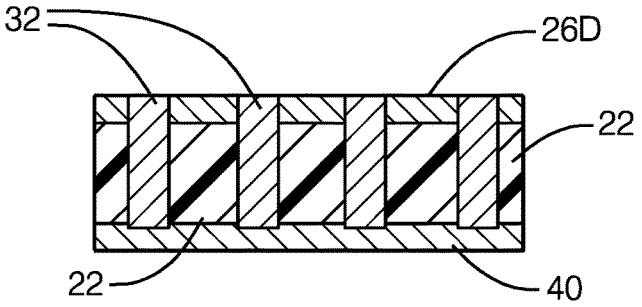
FIG. 3 is a cross-sectional illustration taken along the lines 3-3 in FIG. 2.

As shown in FIG. 3, the conductive vias 32 couple the second end 30 of the conductive patches 26 to a grounding layer 40 on an opposite side of the substrate 22 compared to the side of the substrate 22 on which the conductive patches 26 are supported.

Figure 4:
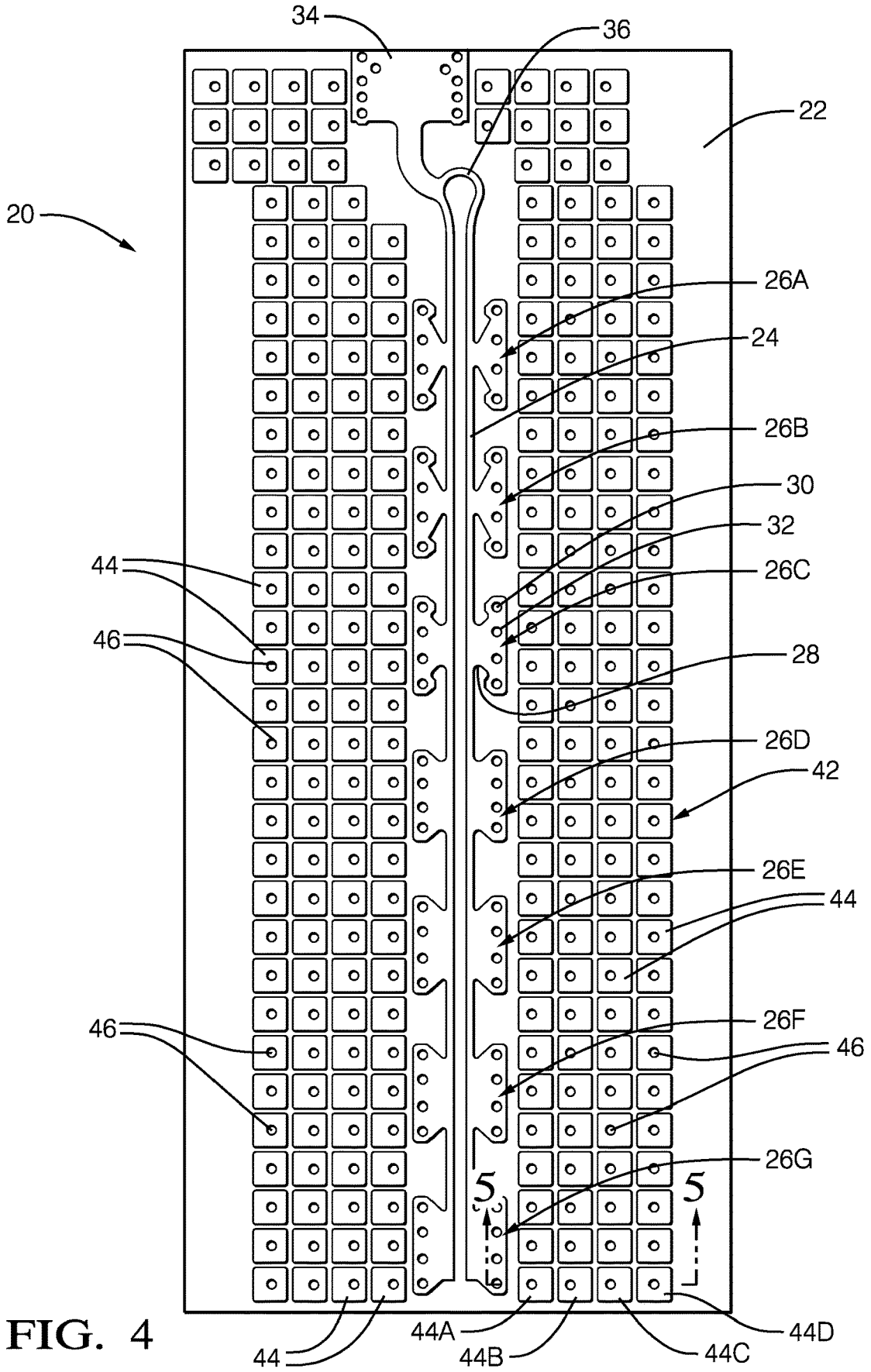
FIG. 4 schematically illustrates another example antenna configuration designed according to an embodiment of this invention.

FIG. 4 illustrates an example embodiment that includes a conductive layer 42 on the same side of the substrate 22 as the conductive patches 26. In this example, the conductive layer 42 includes a plurality of parasitic conductive elements 44 supported on the substrate 22. The parasitic conductive elements 44 are arranged along the substrate 22 so that the conductive layer 42 extends along the entire length of the transmission line 24. The parasitic conductive elements 44 operate to suppress ripples that otherwise would be associated with the radiation from the conductive patches 26.

The conductive layer 42, which is established by the conductive parasitic elements 44, radiates out signal energy from the substrate to avoid such energy being further propagated along the substrate in a way that it would otherwise cause interference with other antennas. The conductive parasitic elements 44 effectively eliminate energy radiating through the substrate 22, which reduces or avoids ripples and interference among multiple antennas situated near each other.

Figure 5:
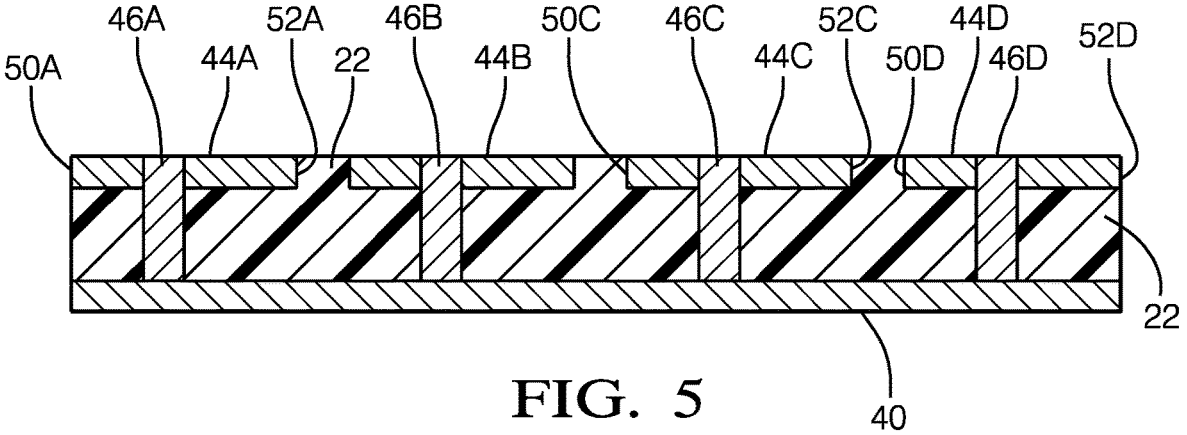
FIG. 5 is a cross-sectional illustration taken along the lines 5-5 in FIG. 4.

The parasitic elements 44 each include a respective conductive via 46 that couples the parasitic element 44 to the ground layer 40. FIG. 5 illustrates how the conductive vias 46 are situated within or along the respective, coupled parasitic conductive elements 44. As can be appreciated from FIGS. 4 and 5, a conductive parasitic element 44A is closer to a conductive patch 26G than conductive parasitic elements 44B, 44C, and 44D. The position of the respective conductive vias 46 varies depending on the distance between the conductive patches 26 and the corresponding parasitic conductive element 44.

The conductive via 46A associated with the conductive parasitic element 44A is closer to one edge 50A than an opposite edge 52A of that conductive parasitic element 44A. As the conductive parasitic elements 44 are situated progressively further from the conductive patches 26, the corresponding vias 46 are situated closer to a center of the coupled parasitic conductive element 44. In this example, the conductive via 46D is approximately centered between the edges 50D and 52D of the conductive parasitic element 44D. The different conductive via positions relative to the coupled parasitic conductive elements 44 addresses the fact that power decays moving along the substrate 22 in a direction away from the conductive patches 26. In the example of FIG. 5, the conductive parasitic element 44D experiences a lower radiation power compared to the conductive parasitic elements 44A and 44B, which have their respective conductive vias 46A and 46B closer to the edge 50 that is facing toward the conductive patch 26G.

Figure 6:
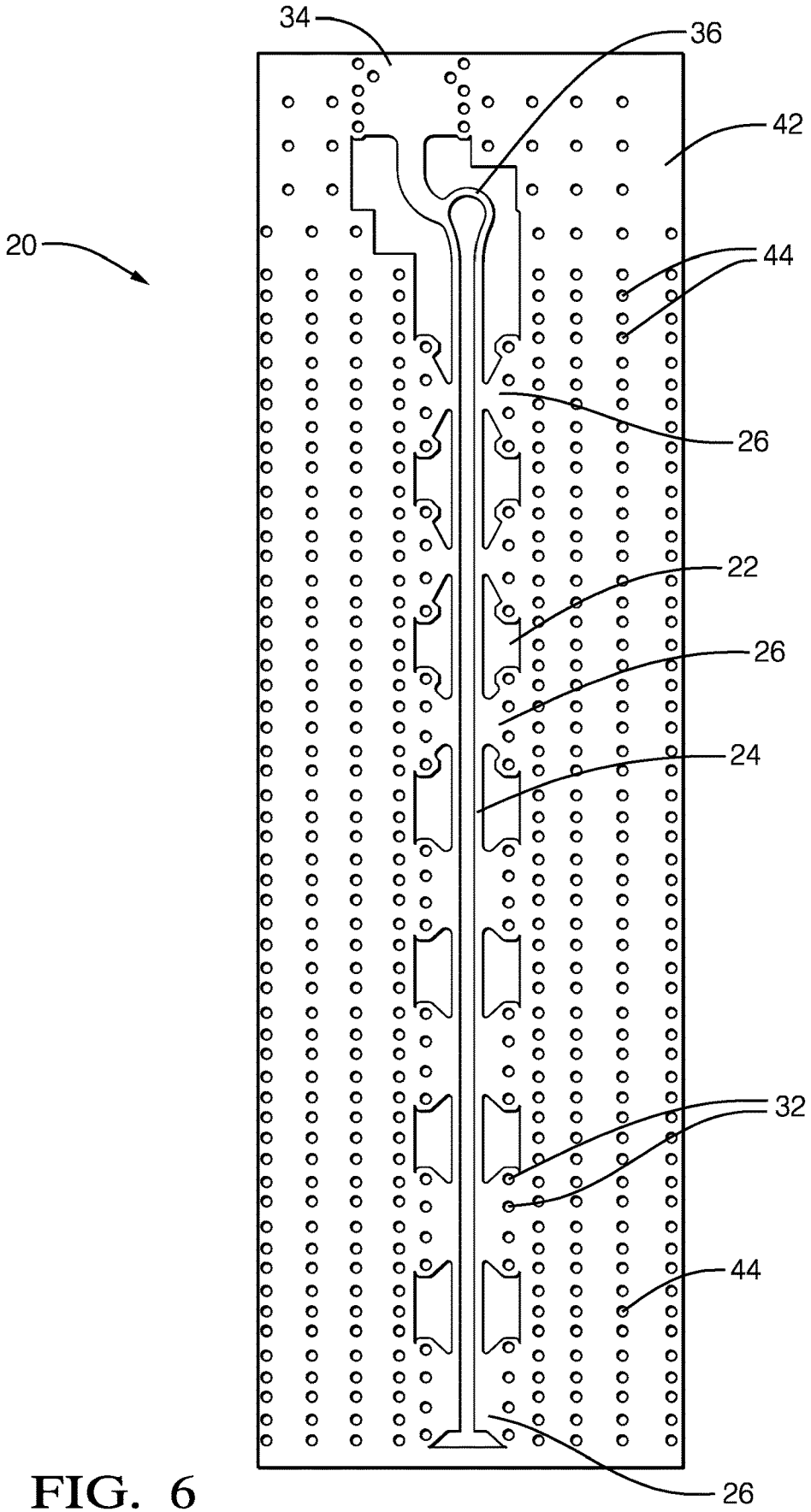
FIG. 6 schematically illustrates another example antenna configuration designed according to an embodiment of this invention.

FIG. 6 illustrates another example embodiment in which the conductive layer 42 is a continuous layer of a conductive material supported on the same side of the substrate 22 as the conductive patches 26.

With any of the example embodiments, the radiating power of the antenna device 20 is controllable by selecting the widths $W_1$ and $W_2$ of the conductive patches 26. Using different widths along the transmission line 24 allows for controlling the power distribution along the antenna device 20. Including a conductive layer 42 reduces or avoids ripple effects. With any of the example embodiments, it becomes possible to achieve wider operation bandwidth and radiation beamwidth while using relatively thin substrate layers, which provides a cost-effective and efficient antenna.

While different embodiments are shown with features that appear distinct, such features are not limited to the particular embodiments disclosed above. Other combinations of such features are possible to realize other embodiments.

The preceding description is illustrative rather than limiting in nature. Variations and modifications to the disclosed example embodiments may become apparent to those skilled in the art without departing from the essence of this invention. The scope of legal protection provided to this invention can only be determined by studying the following claims.

We claim:

1. An antenna device, comprising:

a substrate;

a transmission line supported on the substrate; and a plurality of conductive patches supported on the substrate, each conductive patch having a first end coupled to the transmission line and a second end coupled to ground, the plurality of conductive patches being arranged in sets including two of the conductive patches facing each other on opposite sides of the transmission line, the conductive patches respectively having a first width near the first end and a second width near the second end, wherein the second width is different than the first width and a radiating power of the conductive patches, respectively, is based on at least the first width.

2. The antenna device of claim 1, wherein the conductive patches respectively have a distance between the first end and the second end; and an operating frequency of the antenna device is based on the distance.

3. The antenna device of claim 1, wherein the first width of two of the conductive patches is different than the first width of two others of the conductive patches.

4. The antenna device of claim 3, wherein the two of the conductive patches are closer to a first end of the transmission line;

the two others of the conductive patches are closer to a second, opposite end of the transmission line; and the first end of the transmission line is coupled to a source of radiation.

5. The antenna device of claim 1, wherein a radiating power of the conductive patches, respectively, is based on the second width.

6. The antenna device of claim 1, wherein the conductive patches are situated on one side of the substrate;

the substrate includes a grounding layer spaced from the one side of the substrate; and the conductive patches respectively include a plurality of conductive vias coupled to the grounding layer.

7. The antenna device of claim 1, wherein a length between the second ends of the conductive patches in each set corresponds to ½ wavelength in the substrate of radiation radiated by the conductive patches.

8. The antenna device of claim 1, comprising a conductive layer near the conductive patches; and a plurality of conductive vias coupled between the conductive layer and ground.

9. The antenna device of claim 8, wherein the conductive layer comprises a plurality of parasitic conductive elements; and each of the parasitic conductive elements is coupled with one of the conductive vias.

10. The antenna device of claim 9, wherein each conductive via is situated in a position relative to edges of a coupled one of the parasitic conductive elements; and the position of some of the vias is different than the position of others of the vias.

11. The antenna device of claim 10, wherein the parasitic conductive elements coupled to the some of the vias are closer to the conductive patches than the parasitic conductive elements coupled to the others of the vias; and the respective position of the others of the vias is closer to a center of the respective coupled parasitic conductive elements than the position of the some of the vias.

12. The antenna device of claim 8, wherein the conductive layer is coupled to the second ends of the conductive patches; and the conductive layer has a dimension parallel to the transmission line that is at least as long as the transmission line.

13. The antenna device of claim 8, wherein the conductive patches are on one surface of the substrate; and the conductive layer is on the one surface of the substrate.

14. The antenna device of claim 8, wherein the conductive layer comprises a continuous layer of conductive material.

15. The antenna device of claim 1, wherein the transmission line comprises a differential twin line.

16. The antenna device of claim 1, comprising a source of radiation that provides an unbalanced signal; and a transition coupling the source of radiation to the transmission line, the transition balancing the unbalanced signal before the signal propagates along the transmission line.

17. The antenna device of claim 16, wherein the source of radiation comprises a substrate integrated waveguide; and the transition comprises a balun.

18. The antenna device of claim 1, wherein the conductive patches each have a geometric configuration; and the geometric configuration of the two conductive patches in each set is the same.

* * * * *